US008105057B2

(12) United States Patent
Chen et al.

(10) Patent No.: US 8,105,057 B2
(45) Date of Patent: Jan. 31, 2012

(54) FLUID TRANSPORTATION DEVICE HAVING MULTIPLE DOUBLE-CHAMBER ACTUATING STRUCTURES

(75) Inventors: Shih Chang Chen, Hsin-Chu (TW); Ying Lun Chang, Hsin-Chu (TW); Rong Ho Yu, Hsin-Chu (TW); Shih Che Chiu, Hsin-Chu (TW); Tsung Pat Chou, Hsin-Chu (TW)

(73) Assignee: Microjet Technology Co., Ltd., Hsin-Chu (TW)

( * ) Notice: Subject to any disclaimer, the term of this patent is extended or adjusted under 35 U.S.C. 154(b) by 461 days.

(21) Appl. No.: 12/382,950

(22) Filed: Mar. 27, 2009

(65) Prior Publication Data

US 2009/0242060 A1 Oct. 1, 2009

(30) Foreign Application Priority Data

Mar. 31, 2008 (CN) ..... 2008 1 0090956

(51) Int. Cl.
*F04B 43/06* (2006.01)
*F04B 45/053* (2006.01)

(52) U.S. Cl. ..... 417/533; 417/413.1

(58) Field of Classification Search ..... 417/413–413.3, 417/533, 566, 322, 395
See application file for complete search history.

(56) References Cited

U.S. PATENT DOCUMENTS

| | | | | |
|---|---|---|---|---|
| 4,938,742 | A * | 7/1990 | Smits | 604/67 |
| 5,078,581 | A * | 1/1992 | Blum et al. | 417/413.3 |
| 5,836,750 | A * | 11/1998 | Cabuz | 417/322 |
| 7,717,682 | B2 * | 5/2010 | Orr | 417/395 |
| 2007/0077156 | A1 * | 4/2007 | Orr | 417/395 |
| 2009/0217994 | A1 * | 9/2009 | Chen et al. | 137/605 |

* cited by examiner

*Primary Examiner* — Karabi Guharay
(74) *Attorney, Agent, or Firm* — Bacon & Thomas, PLLC

(57) ABSTRACT

A fluid transportation device includes a flow-gathering module and multiple double-chamber actuating structures. The flow-gathering module includes two surfaces opposed to each other, multiple first flow paths and multiple second flow paths running through the two surfaces, an inlet channel arranged between the two surfaces and communicated with the multiple first flow paths, and an outlet channel arranged between the two surfaces and communicated with the multiple second flow paths. The multiple double-chamber actuating structures are arranged on the flow-gathering module side by side. Each double-chamber actuating structure includes a first chamber and a second chamber symmetrically arranged on the two surface of the flow-gathering module. Each of the first chamber and the second chamber includes a valve cap arranged over the flow-gathering module, a valve membrane arranged between the flow-gathering module and the valve cap, and an actuating member having a periphery fixed on the valve cap.

9 Claims, 12 Drawing Sheets

FLUID TRANSPORTATION DEVICE HAVING MULTIPLE DOUBLE-CHAMBER ACTUATING STRUCTURES

FIELD OF THE INVENTION

The present invention relates to a fluid transportation device, and more particularly to a fluid transportation device having multiple double-chamber actuating structures.

BACKGROUND OF THE INVENTION

Nowadays, fluid transportation devices used in many sectors such as pharmaceutical industries, computer techniques, printing industries, energy industries are developed toward miniaturization. The fluid transportation devices used in for example micro pumps, micro atomizers, printheads or industrial printers are very important components. Consequently, it is critical to improve the fluid transportation devices.

FIG. 1 is a schematic view of a conventional micro pump. The conventional micro pump 10 principally comprises a valve seat 11, a valve cap 12, a valve membrane 13, a micro actuator 14 and a cover plate 15. The valve membrane 13 includes an inlet valve structure 131 and an outlet valve structure 132. The valve seat 11 comprises an inlet channel 111 and an outlet channel 112. A pressure cavity 123 is formed between the valve cap 12 and the micro actuator 14. The valve membrane 13 is arranged between the valve seat 11 and the valve cap 12.

When a voltage is applied on both electrodes of the micro actuator 14, an electric field is generated. The electric field causes downward deformation of the micro actuator 14. In a case that the micro actuator 14 is subject to upwardly deformation in the direction X, the volume of the pressure cavity 123 is expanded to result in a suction force. Due to the suction force, the inlet valve structure 131 of the valve membrane 13 is opened and thus the fluid is transported into the pressure cavity 123 through the inlet channel 111 of the valve seat 11, the inlet valve structure 131 of the valve membrane 13 and the inlet valve channel 121 of the valve cap 12. On the other hand, if the micro actuator 14 is subject to downward deformation in a direction opposite to the direction X, the volume of the pressure cavity 123 is shrunk to result in an impulse. The impulse is exerted on the inlet valve structure 131 and the outlet valve structure 132 of the valve membrane 13, so that the outlet valve structure 132 is opened. When the outlet valve structure 132 is opened, the fluid is exhausted from the pressure cavity 123 to the outside of the micro pump 10 through the outlet valve channel 122 of the valve cap 12, the outlet valve structure 132 of the valve membrane 13 and the outlet channel 112 of the valve seat 11. Meanwhile, a fluid transporting cycle is completed.

Although the conventional micro pump 10 is effective for transporting a fluid, there are still some drawbacks. For example, the conventional micro pump 10 has a single actuator, a signal pressure cavity, a single flow path, a single inlet/outlet and a single pair of valve structures. For increasing the flow rate of the micro pump 10, an additional coupling mechanism is required to connect multiple micro pump units, which are stacked. Since the use of the coupling mechanism is very costly and the overall volume of multiple micro pump units is very bulky, the final product fails to meet the miniaturization demand.

For increasing the flow rate and reducing the overall volume, there is a need of providing a fluid transportation device having multiple double-chamber actuating structures so as to obviate the drawbacks encountered from the prior art.

SUMMARY OF THE INVENTION

As previously described, an additional coupling mechanism is required to connect multiple micro pump units and stack the micro pump units in order to increase the flow rate of the conventional micro pump. The use of the coupling mechanism is very costly and the overall volume of multiple micro pump units is very bulky, the final product fails to meet the miniaturization demand. For increasing the flow rate and reducing the overall volume, the present invention provides a fluid transportation device having multiple double-chamber actuating structures.

In accordance with an aspect of the present invention, there is provided a fluid transportation device having multiple double-chamber actuating structures for transporting a fluid. The fluid transportation device includes a flow-gathering module and multiple double-chamber actuating structures. The flow-gathering module includes two surfaces opposed to each other, multiple first flow paths and multiple second flow paths running through the two surfaces, an inlet channel arranged between the two surfaces and communicated with the multiple first flow paths, and an outlet channel arranged between the two surfaces and communicated with the multiple second flow paths. The multiple double-chamber actuating structures are arranged on the flow-gathering module side by side. Each double-chamber actuating structure includes a first chamber and a second chamber symmetrically arranged on the two surface of the flow-gathering module. Each of the first chamber and the second chamber includes a valve cap arranged over the flow-gathering module, a valve membrane arranged between the flow-gathering module and the valve cap, and an actuating member having a periphery fixed on the valve cap.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The fluid transportation device of the present invention includes a flow-gathering module and multiple double-chamber actuating structures. The multiple double-chamber actuating structures are symmetrically stacked on the flow-gathering module. The fluid transportation device of the present invention is capable of increasing flow rate and head without largely increasing the overall volume thereof. That is, the fluid transportation device of the present invention is feasible to the applications requiring high flow rate and high head.

Figure 1:
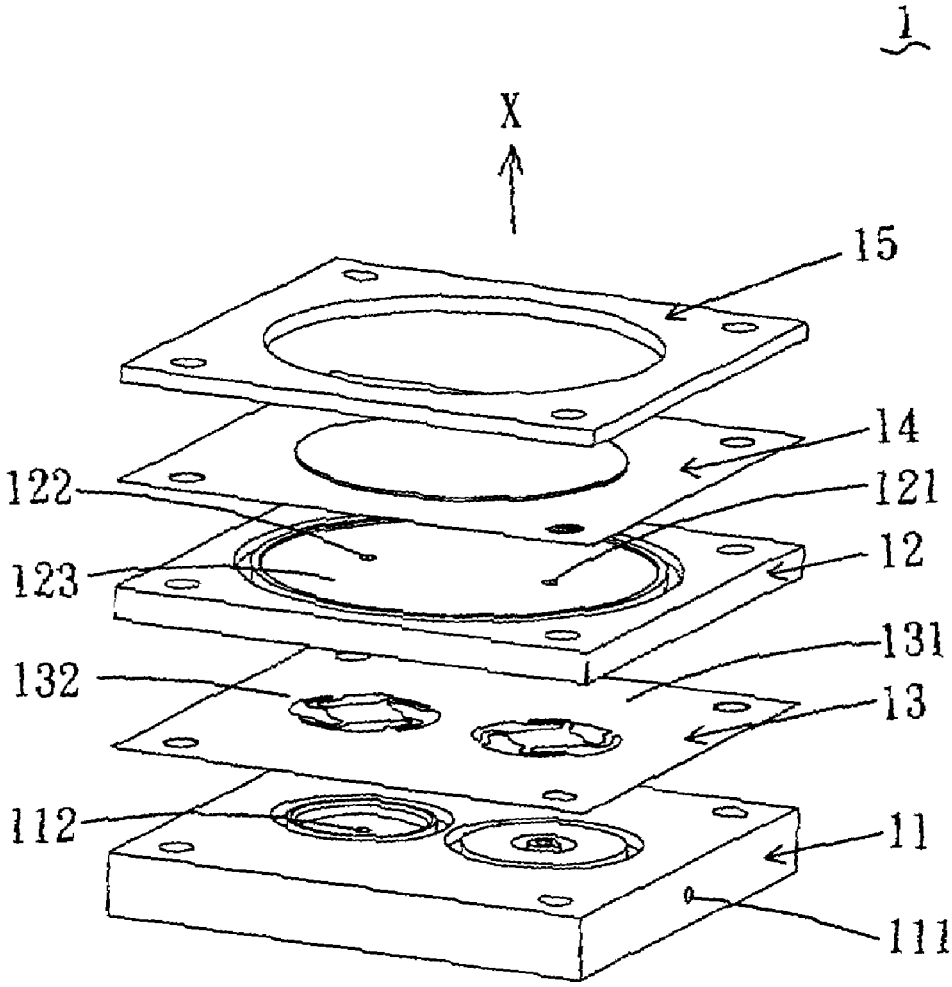
FIG. 1 (PRIOR ART)
FIG. 1 is a schematic view of a conventional micro pump.
Figure 2:
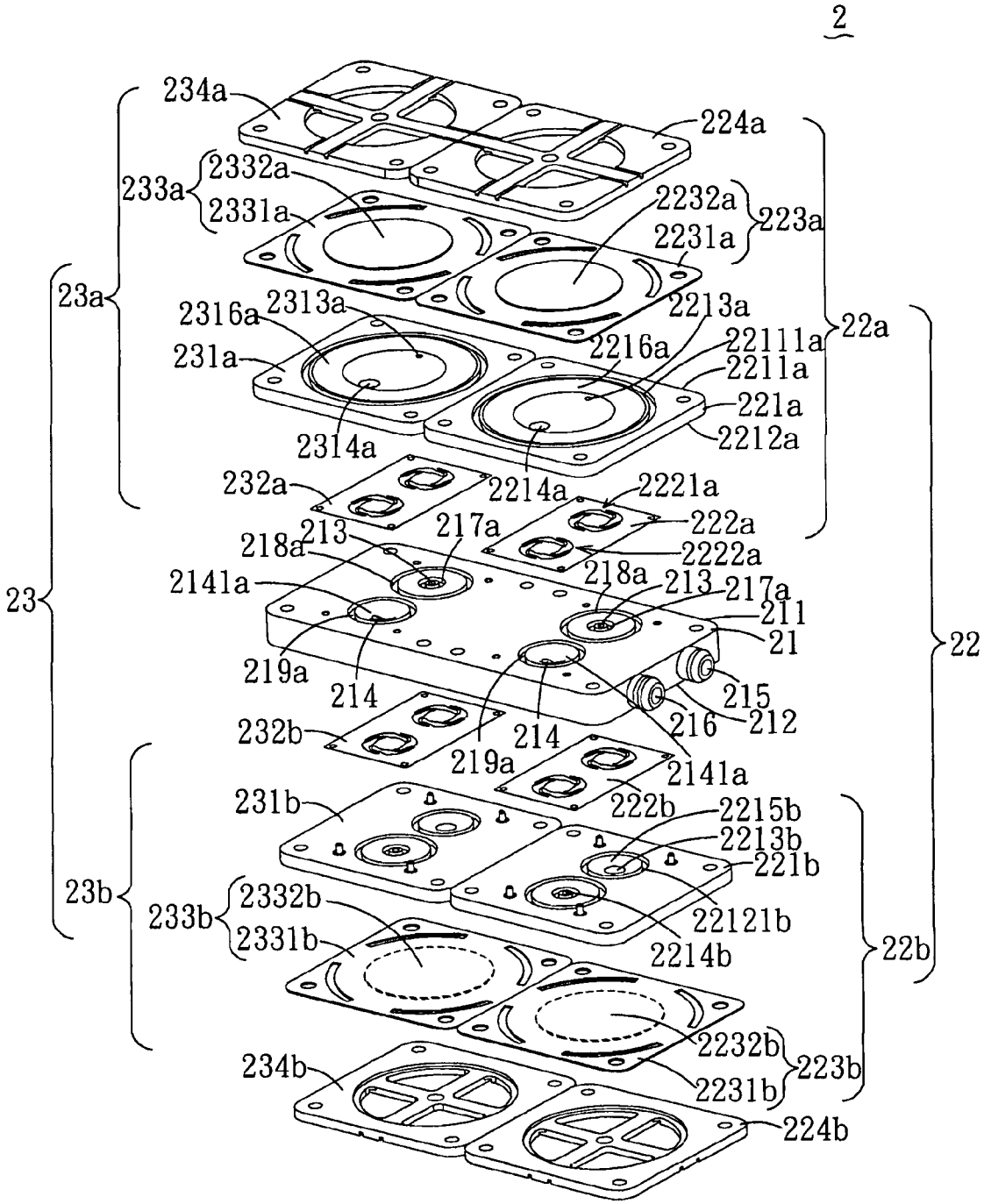
FIG. 2 is a schematic exploded view illustrating a fluid transportation device having multiple double-chamber actuating structures according to an embodiment of the present invention.

FIG. 2 is a schematic exploded view illustrating a fluid transportation device having multiple double-chamber actuating structures according to an embodiment of the present invention. The fluid transportation device 2 of the present invention comprises a flow-gathering module 21 and multiple double-chamber actuating structures. For clarification and brevity, only two double-chamber actuating structures are shown in the drawings. That is, the fluid transportation device 2 has a first double-chamber actuating structure 22 and a second double-chamber actuating structure 23. The first double-chamber actuating structure 22 and the second double-chamber actuating structure 23 are substantially identical. The number of the double-chamber actuating structures included in the fluid transportation device 2 of the present invention may be varied according to the practical requirements.

Figure 3A:
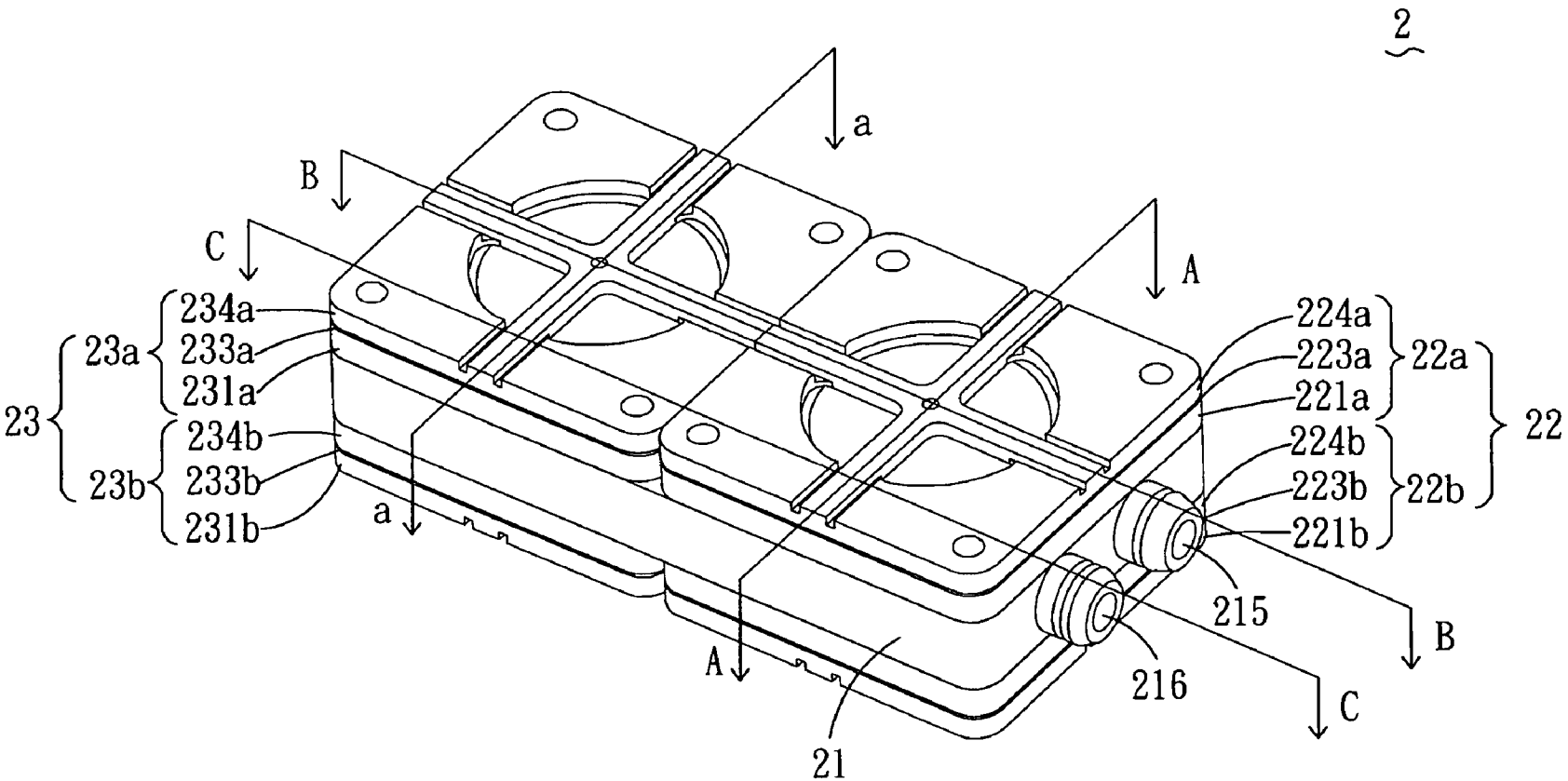
FIG. 3A is a schematic assembled view illustrating the fluid transportation device of FIG. 2.

Each double-chamber actuating structure of the fluid transportation device 2 has two chambers at the upper side and the lower side, respectively. The double-chamber actuating structures are arranged on the flow-gathering module 21 side by side. FIG. 3A is a schematic assembled view illustrating the fluid transportation device of FIG. 2. Please refer to FIG. 2 and FIG. 3A. The first double-chamber actuating structure 22 includes a first chamber 22*a* and a second chamber 22*b*, which are respectively arranged on the first surface 211 and the second surface 212 of the flow-gathering module 21. The first chamber 22*a* has a valve cap 221*a*, a valve membrane 222*a*, an actuating member 223*a* and a cover plate 224*a*. The second chamber 22*b* has a valve cap 221*b*, a valve membrane 222*b*, an actuating member 223*b* and a cover plate 224*b*. The first chamber 22*a* and the second chamber 22*b* are mirror-symmetrical with respect to the flow-gathering module 21.

The second double-chamber actuating structure 23 includes a first chamber 23*a* and a second chamber 23*b*, which are respectively arranged on the first surface 211 and the second surface 212 of the flow-gathering module 21. The first chamber 23*a* has a valve cap 231*a*, a valve membrane 232*a*, an actuating member 233*a* and a cover plate 234*a*. The second chamber 23*b* has a valve cap 231*b*, a valve membrane 232*b*, an actuating member 233*b* and a cover plate 234*b*. The first chamber 23*a* and the second chamber 23*b* are mirror-symmetrical with respect to the flow-gathering module 21.

In this embodiment, the first double-chamber actuating structure 22 and the second double-chamber actuating structure 23 are arranged on the flow-gathering module 21 side by side. That is, the first chamber 22*a* of the first double-chamber actuating structure 22 and the first chamber 23*a* of the second double-chamber actuating structure 23 are arranged on the first surface 211 of the flow-gathering module 21 side by side. In addition, the second chamber 22*b* of the first double-chamber actuating structure 22 and the second chamber 23*b* of the second double-chamber actuating structure 23 are arranged on the second surface 212 of the flow-gathering module 21 side by side.

Figure 3B:
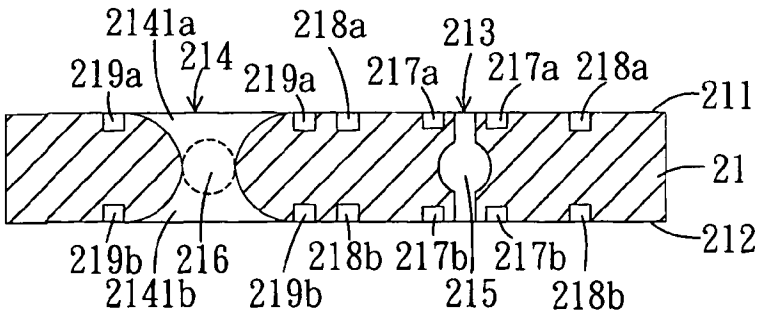
FIG. 3B is a schematic cross-sectional view illustrating the flow-gathering module of the fluid transportation device shown in FIG. 3A and taken along the line A-A or the line a-a.
Figure 3C:
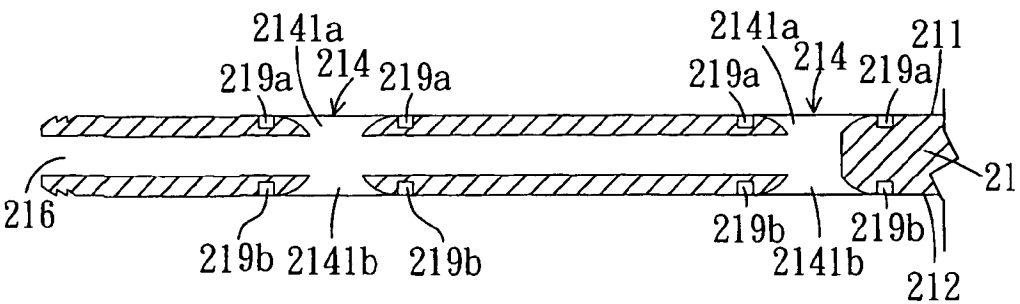
FIG. 3C is a schematic cross-sectional view illustrating the flow-gathering module of the fluid transportation device shown in FIG. 3A and taken along the line C-C.
Figure 3D:
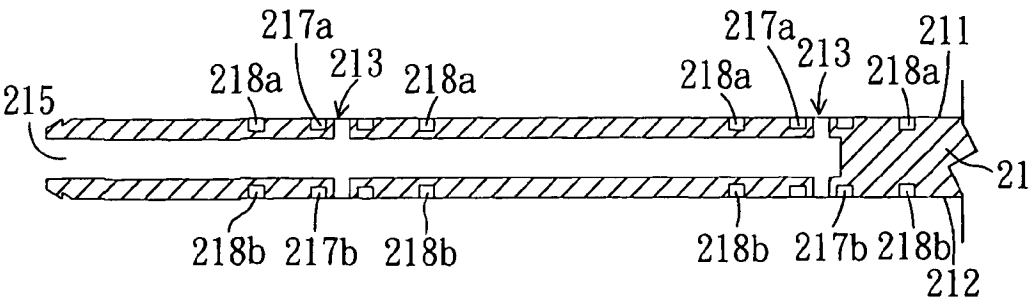
FIG. 3D is a schematic cross-sectional view illustrating the flow-gathering module of the fluid transportation device shown in FIG. 3A and taken along the line B-B.

FIG. 3B is a schematic cross-sectional view illustrating the flow-gathering module of the fluid transportation device shown in FIG. 3A and taken along the line A-A or the line a-a. FIG. 3C is a schematic cross-sectional view illustrating the flow-gathering module of the fluid transportation device shown in FIG. 3A and taken along the line C-C. FIG. 3D is a schematic cross-sectional view illustrating the flow-gathering module of the fluid transportation device shown in FIG. 3A and taken along the line B-B. Please refer to FIG. 2, FIG. 3A, FIG. 3B, FIG. 3C, and FIG. 3D. The flow-gathering module 21 is substantially rectangular bar having the first surface 211 and the second surface 212, which are opposed to each other. The flow-gathering module 21 has multiple first flow paths, multiple second flow paths, an inlet channel 215 and an outlet channel 216. As shown in FIGS. 3B, 3C and 3D, the multiple first flow paths are multiple inlet branch flow paths 213 that vertically run through the first surface 211 and the second surface 212. The multiple second flow paths are multiple outlet confluent flow paths 214 that vertically run through the first surface 211 and the second surface 212. In other words, the openings of respective inlet branch flow paths 213 at the first surface 211 and the second surface 212 are coaxial. Similarly, the openings of respective outlet confluent flow paths 214 are coaxial. The inlet branch flow paths 213 and the outlet confluent flow paths 214 are independent from each other (see FIG. 3). The first surface 211 and the second surface 212 are communicated with each other through the inlet branch flow paths 213 and the outlet confluent flow paths 214.

Please refer to FIG. 3C and FIG. 3D again. The inlet channel 215 and the outlet channel 216 are pipelines between the first surface 211 and the second surface 212. The external flow is introduced into the fluid transportation device 2 through the inlet channel 215. The internal flow is ejected out of the fluid transportation device 2 through the outlet channel 216. The inlet channel 215 is communicated with the inlet branch flow paths 213 (see FIG. 3D). The outlet channel 216 is communicated with the outlet confluent flow paths 214 (see FIG. 3C). After the fluid transportation device is assembled, the inlet branch flow paths 213 are communicated with the surrounding environment through the inlet channel 215, and the outlet confluent flow paths 214 are communicated with the surrounding environment through the outlet channel 216.

Please refer to FIG. 3B and FIG. 3C again. The outlet confluent flow paths 214 that are close to the first surface 211 are outwardly expanded, so that a second buffer zone (i.e. the outlet buffer cavity 2141*a*) is collectively defined by the valve membrane 222*a* and 232*a* that are on the first surface 211. The outlet confluent flow paths 214 that are close to the second surface 212 are outwardly expanded, so that another outlet buffer cavity 2141*b* is collectively defined by the valve membrane 222*b* and 232*b*. As such, the fluid introduced into the first chambers 22*a*, 23*a* and the second chambers 22*b*, 23*b* can be temporarily stored in the outlet buffer cavities 2141*a* and 2141*b*, then smoothly flows into the outlet confluent flow paths 214, and finally ejected out of the fluid transportation device 2 through the outlet channel 216.

Figure 6A:
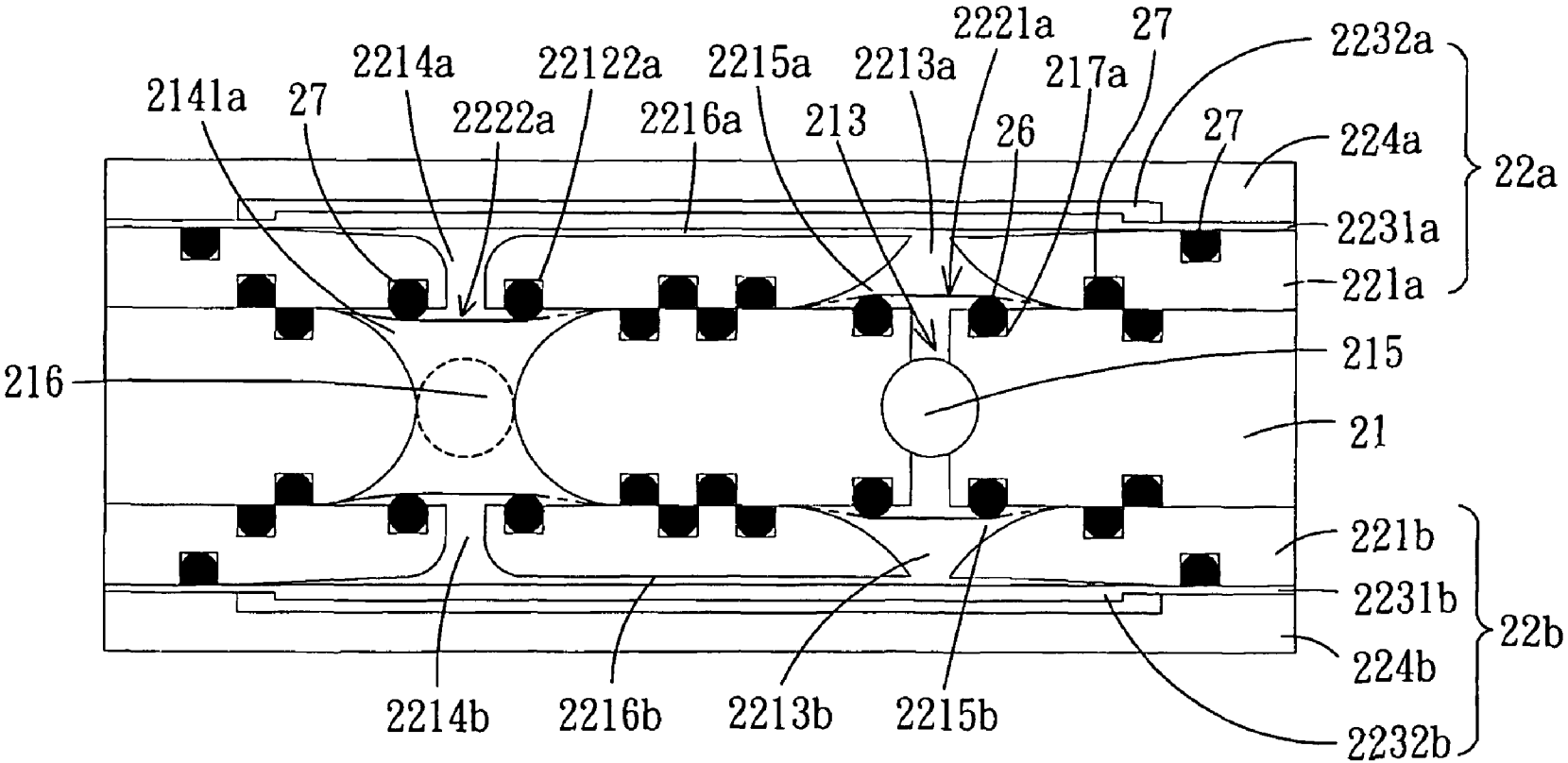
FIG. 6A is a schematic cross-sectional view illustrating the fluid transportation device shown in FIG. 3A and taken along the line A-A, wherein the fluid transportation device is in a non-actuation status.

Moreover, several recess structures are formed in the first surface 211 and the second surface 212. The recess structures 217*a*, 218*a*, 217*b* and 218*b* are arranged in the outer peripheries of the inlet branch flow paths 213 and annularly surround the inlet branch flow paths 213. The recess structures 219*a* and 219*b* are arranged in the outer peripheries of the outlet confluent flow paths 214 and annularly surround the outlet confluent flow paths 214. The recess structures 217*a*, 218*a*, 219*a*, 217*b*, 218*b* and 219*b* are used for accommodating corresponding sealing rings 26 (as shown in FIG. 6A).

In this embodiment, the flow-gathering module 21 is made of thermoplastic material. The sealing rings 26 are circular rings made of chemical-resistant and soft material. For example, the sealing rings 26 are rubbery rings that are methanol-resistant or acetic acid-resistant but not limited to the materials listed above.

Please refer to FIG. 2 again. The valve membrane 222*a*, the valve cap 221*a*, the actuating member 223*a* and the cover plate 224*a* of the first chamber 22*a* of the first double-chamber actuating structure 22 are stacked on the first surface 211 of the flow-gathering module 21. Likewise, the valve membrane 232*a*, the valve cap 231*a*, the actuating member 233*a* and the cover plate 234*a* of the first chamber 23*a* of the second double-chamber actuating structure 23 are stacked on the first surface 211 of the flow-gathering module 21. The valve membrane 222*a* is arranged between the first surface 211 of the flow-gathering module 21 and the valve cap 221*a*, and aligned with the flow-gathering module 21 and the valve cap 221*a*. Likewise, the valve membrane 232*a* is arranged between the first surface 211 of the flow-gathering module 21 and the valve cap 231*a*, and aligned with the flow-gathering module 21 and the valve cap 231*a*. The actuating member 223*a* is disposed above the valve cap 221*a*, and comprises a vibration film 2231*a* and an actuator 2232*a*. Likewise, the actuating member 233*a* is disposed above the valve cap 231*a*, and comprises a vibration film 2331*a* and an actuator 2332*a*. When a voltage is applied on the actuating member 223*a* or 233*a*, the actuating member 223*a* or 233*a* is subject to vibration so as to actuate the fluid transportation device 2. The cover plate 224*a* and 234*a* are respectively disposed over the actuating members 223*a* and 233*a* for sealing the first chambers 22*a* and 23*a*. After the valve membrane 222*a*, the valve cap 221*a*, the actuating member 223*a* and the cover plate 224*a* are sequentially stacked from bottom to top and fixed on the first surface 211 of the flow-gathering module 21 by a fastening element (not shown), the first chamber 22*a* of the first double-chamber actuating structure 22 is defined. Likewise, after the valve membrane 232*a*, the valve cap 231*a*, the actuating member 233*a* and the cover plate 234*a* of the first chamber 23*a* are sequentially stacked from bottom to top and fixed on the first surface 211 of the flow-gathering module 21 by a fastening element (not shown), the first chamber 23*a* of the second double-chamber actuating structure 23 is defined. As previously, the second chamber 22*b* of the first double-chamber actuating structure 22 is disposed on the second surface 212 of the flow-gathering module 21, wherein the first chamber 22*a* and the second chamber 22*b* are mirror-symmetrical with respect to the flow-gathering module 21. The second chamber 23*b* of the second double-chamber actuating structure 23 is disposed on the second surface 212 of the flow-gathering module 21, wherein the first chamber 23*a* and the second chamber 23*b* are mirror-symmetrical with respect to the flow-gathering module 21 (see FIGS. 2 and 6A). For clearly describing the fluid transportation device 2, only the first chamber 22*a* of the first double-chamber actuating structure 22 is illustrated in more details as follows.

Figure 4A:
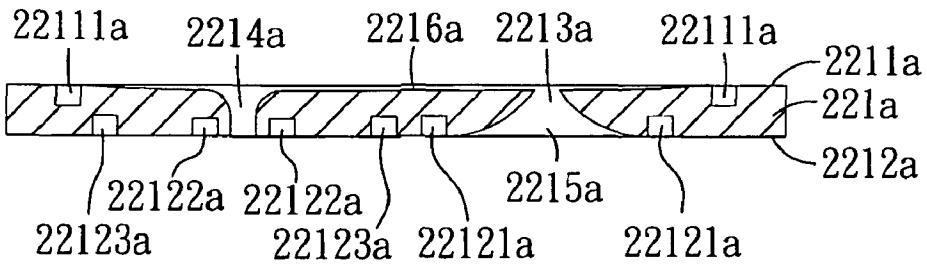
FIG. 4A is a schematic cross-sectional view illustrating the valve cap of the first chamber included in the first double-chamber actuating structure of the fluid transportation device shown in FIG. 3A and taken along the line A-A.
Figure 4B:
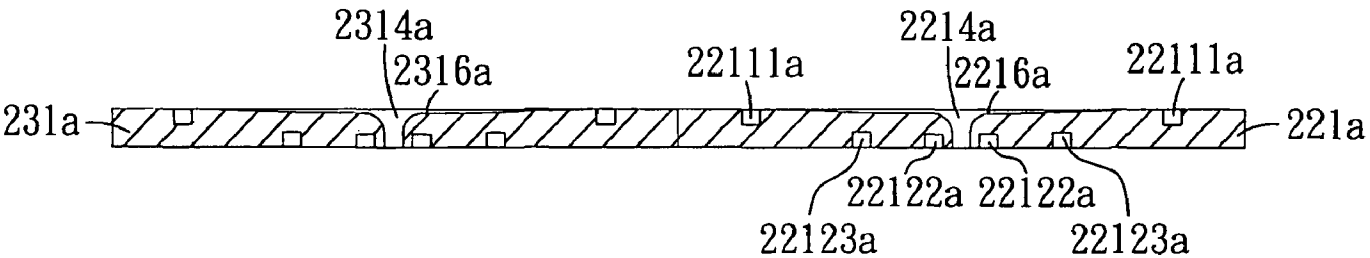
FIG. 4B is a schematic cross-sectional view illustrating the valve caps of the first chambers included in the first and second double-chamber actuating structures of the fluid transportation device shown in FIG. 3A and taken along the line C-C.
Figure 4C:
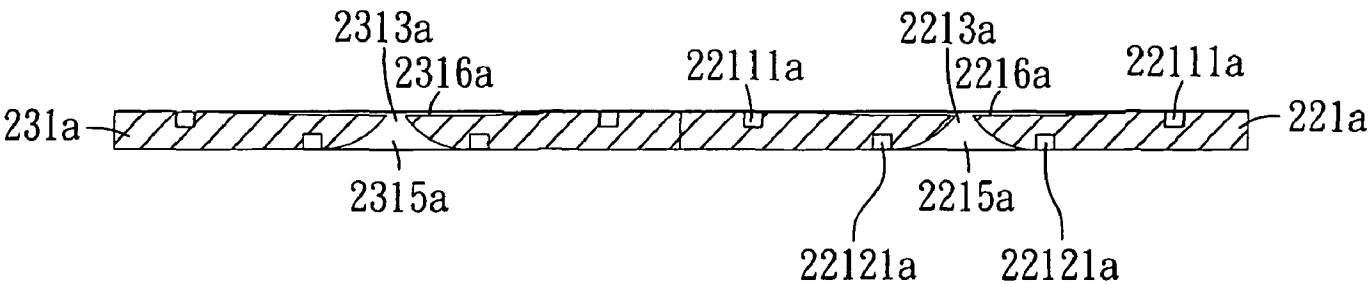
FIG. 4C is a schematic cross-sectional view illustrating the valve caps of the first chambers included in the first and second double-chamber actuating structures of the fluid transportation device shown in FIG. 3A and taken along the line B-B.

FIG. 4A is a schematic cross-sectional view illustrating the valve cap of the first chamber included in the first double-chamber actuating structure of the fluid transportation device shown in FIG. 3A and taken along the line A-A. FIG. 4B is a schematic cross-sectional view illustrating the valve caps of the first chambers included in the first and second double-chamber actuating structures of the fluid transportation device shown in FIG. 3A and taken along the line C-C. FIG. 4C is a schematic cross-sectional view illustrating the valve caps of the first chambers included in the first and second double-chamber actuating structures of the fluid transportation device shown in FIG. 3A and taken along the line B-B. Please refer to FIGS. 4A, 4B, 4C, 2 and 3A. As shown in FIG. 2, the valve cap 221*a* of the first chamber 22*a* of the first double-chamber actuating structure 22 is disposed on the first surface 211 of the flow-gathering module 21. The valve cap 221*a* has an upper surface 2211*a* and a lower surface 2212*a*. The lower surface 2212*a* faces the first surface 211 of the flow-gathering module 21. The valve membrane 222*a* is sandwiched between the lower surface 2212*a* of the valve cap 221*a* and the first surface 211 of the flow-gathering module 21. The valve cap 221*a* further comprises a first valve channel and a second valve channel that run through the upper surface 2211*a* and the lower surface 2212*a*. In this embodiment, the first valve channel is an inlet valve channel 2213*a*, and the second valve channel is an outlet valve channel 2214*a* (see FIGS. 2 and 4B). The inlet valve channel 2213*a* is aligned with an inlet branch flow path 213. The outlet valve channel 2214*a* is aligned with the outlet buffer cavity 2141*a* (see FIGS. 2 and 6). The inlet valve channel 2213*a* of the valve cap 221*a* that is close to the lower surface 2212*a* is outwardly expanded, so that a first buffer zone is collectively defined by the valve cap 221*a* and the valve membrane 222*a*. In this embodiment, the first buffer zone is an inlet buffer cavity 2215*a*, which is concavely formed in the lower surface 2212*a* of the valve cap 221*a* and corresponding to the inlet valve channel 2213*a*. The inlet buffer cavity 2215*a* is communicated with the inlet valve channel 2213*a* (see FIGS. 6A and 4C).

Please refer to FIGS. 2 and 6A again. The upper surface 2211*a* of the valve cap 221*a* is partially depressed, so that a pressure cavity 2216*a* is collectively defined by the concave portion of the upper surface 2211*a* and the actuating member 223*a*. The pressure cavity 2216*a* is communicated with the inlet buffer cavity 2215*a* through the inlet valve channel 2213*a* (see FIG. 4C). The pressure cavity 2216*a* is also communicated with the outlet buffer cavity 2141*a* (see FIG. 4B). Moreover, several recess structures are formed in the valve cap 221*a*. The recess structures 22121*a*, 22122*a* and 22123*a* are formed in the lower surface 2212*a* of the valve cap 221*a*. The recess structure 22121*a* annularly surrounds the inlet valve channel 2213*a*. The recess structures 22122*a* and 22123*a* annularly surround the outlet buffer cavity 2141*a*. The recess structure 22111*a* is formed in the upper surface 2211*a* of the valve cap 221*a*. The recess structure 22111*a* annularly surrounds the pressure cavity 2216*a*. The recess structures 22121*a*, 22122*a*, 22123*a* and 22111*a* are used for accommodating corresponding sealing rings 27 (see FIG. 6A). In this embodiment, the valve cap 221*a* is made of thermoplastic material. In addition, the valve cap 221*a* and the flow-gathering module 21 are made of the same material. The sealing rings 27 and the sealing rings 26 are made of the same material, and are not redundantly described herein.

Figure 5:
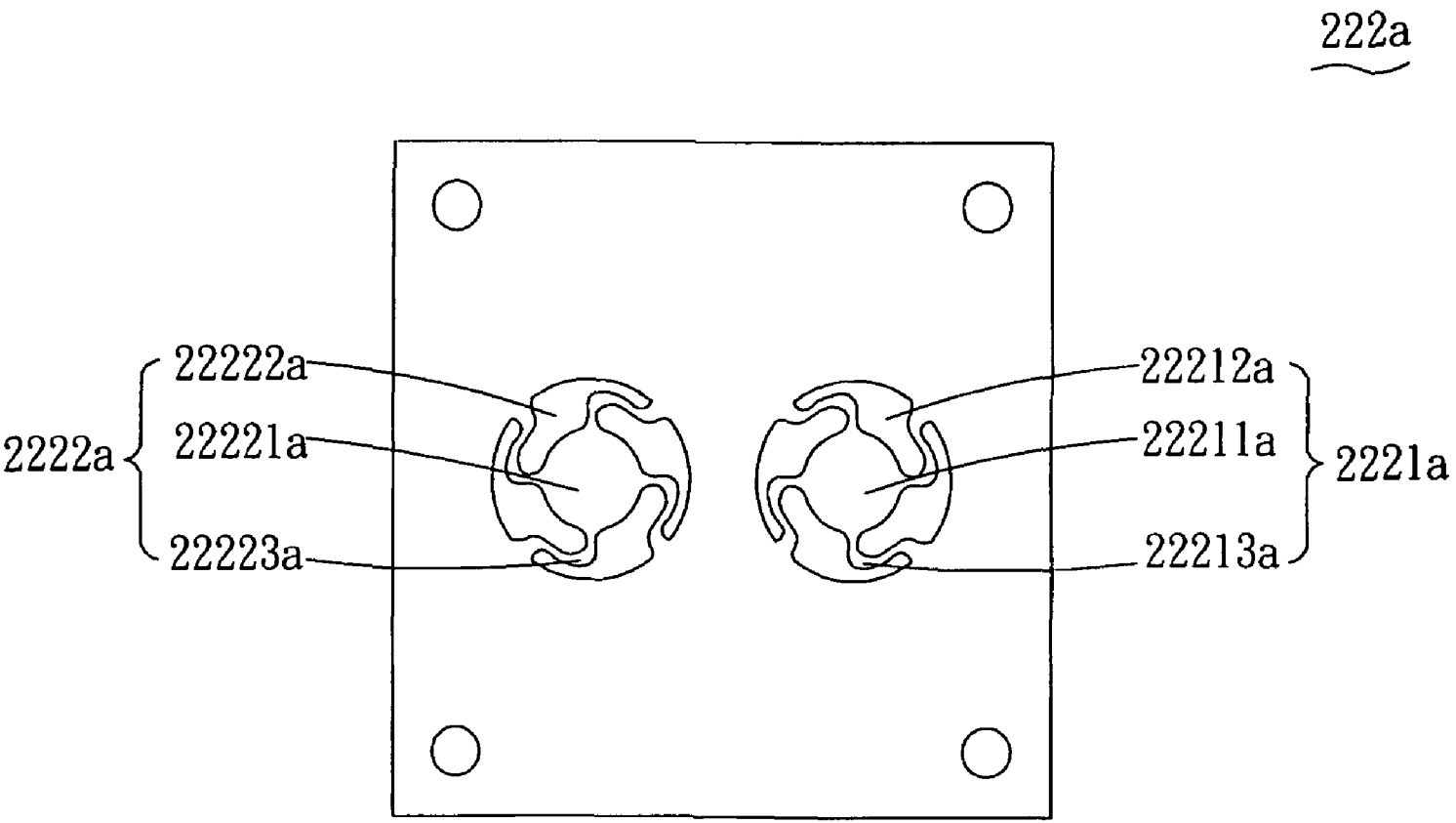
FIG. 5 is a schematic cross-sectional view illustrating the valve membrane of the first chamber included in the first double-chamber actuating structure of the fluid transportation device shown in FIG. 2.

FIG. 5 is a schematic cross-sectional view illustrating the valve membrane of the first chamber included in the first double-chamber actuating structure of the fluid transportation device shown in FIG. 2. Please refer to FIGS. 2, 5 and 6A. The valve membrane 222*a* is produced by a conventional machining process, a photolithography and etching process, a laser machining process, an electroforming process or an electric discharge machining process. The valve membrane 222*a* is a sheet-like membrane with substantially uniform thickness and comprises several hollow-types valve switches (e.g. first and second valve switches). In this embodiment, the first valve switch is an inlet valve structure 2221*a* and the second valve switch is an outlet valve structure 2222*a*. The inlet valve structure 2221*a* is aligned with the inlet branch flow path 213 of the flow-gathering module 21, the inlet valve channel 2213*a* of the valve cap 221*a* and the inlet buffer cavity 2215*a*. The outlet valve structure 2222*a* is aligned with the outlet confluent flow path 214 of the flow-gathering module 21, the outlet buffer cavity 2141*a* and the outlet valve channel 2214*a* of the valve cap 221*a* (see FIG. 6A).

Please refer to FIG. 5. The inlet valve structure 2221*a* includes an inlet valve slice 22211*a* and several perforations 22212*a* formed in the periphery of the inlet valve slice 22211*a*. In addition, the inlet valve structure 2221*a* has several extension parts 22213*a* between the inlet valve slice 22211*a* and the perforations 22212*a*. Similarly, the outlet valve structure 2222*a* comprises an outlet valve slice 22221*a*, several perforations 22222*a* and several extension parts 22223*a*. The configurations and the operation principles of the outlet valve slice 22221*a*, the perforations 22222*a* and the extension parts 22223*a* included in the outlet valve structure 2222*a* are similar to corresponding components of the inlet valve structure 2221*a*, and are not redundantly described herein. In this embodiment, the valve membrane 222*a* is a flexible sheet-like membrane with substantially uniform thickness. The valve membrane 222*a* is made of excellent chemical-resistant organic polymeric material or metallic material, which includes but is not limited to polyimide (PI), aluminum, nickel, stainless steal, copper, copper alloy or nickel alloy.

As previously described, the valve membrane 222*a* is a flexible sheet-like membrane, and the valve membrane 222*a* is arranged between the first surface 21 of the flow-gathering module 21 and the valve cap 221*a*. If the volume of the pressure cavity 2216*a* is expanded to result in suction, the suction will cause the inlet valve structure 2221*a* and the outlet valve structure 2222*a* to shift toward the pressure cavity 2216*a*. Since the inlet valve channel 2213*a* and the outlet valve channel 2214*a* have distinguishable structure at the lower surface 2212*a* of the valve cap 221*a* (see FIGS. 4A and 6A), a negative pressure difference in the pressure cavity 2216*a* only causes the inlet valve structure 2221*a* of the valve membrane 222*a* to shift toward the valve cap 221*a* (see FIGS. 6B and 7B). At this moment, the outlet valve structure 2222*a* is attached on the lower surface 2212*a* of the valve cap 221*a* (see FIGS. 6B and 8B), and thus the fluid can only be transported from the flow-gathering module 21 to the valve cap 221*a* through the perforations 22212*a* of inlet valve structure 2221*a* (along the direction indicated as an arrow, see FIGS. 6B and 7B), and then transmitted to the pressure cavity 2216*a* through the inlet buffer cavity 2215*a* and the inlet valve channel 2213*a*. Under this circumstance, the outlet valve structure 2222*a* is closed, so that the fluid is not returned back.

Similarly, since the inlet branch flow paths 213 and the outlet confluent flow paths 214 have distinguishable structure at the first surface 211 of the flow-gathering module 21 (see FIGS. 2 and 3B), a positive pressure difference in the pressure cavity 2216*a* causes downward force of the valve membrane 222*a*. In response to the downward force of the valve membrane 222*a*, the outlet valve structure 2222*a* is shifted toward the flow-gathering module 21. At this moment, the inlet valve structure 2221*a* is attached on the first surface 211 of the flow-gathering module 21 to seal the inlet branch flow paths 213 of the flow-gathering module 21, and thus the inlet valve structure 2221*a* is closed (see FIGS. 6C and 7C). In other words, the fluid can only be transported from the pressure cavity 2216*a* to the outlet valve channel 2214*a* of the flow-gathering module 21 through the perforations 22222*a* of the outlet valve structure 2222*a* (see FIGS. 6C and 8C). Under this circumstance, the inlet valve structure 2221*a* is quickly opened or closed in response to the positive or negative pressure difference in the pressure cavity 2216*a*, so that the outlet valve structure 2222*a* is correspondingly opened or closed to control transportation of the fluid and preventing the fluid from being returned back.

Please refer to FIG. 2 again. In the first chamber 22*a* of the first double-chamber actuating structure 22, the actuating member 223*a* includes a vibration film 2231*a* and an actuator 2232*a*. The actuating member 223*a* has a periphery fixed on the valve cap 221*a*, so that the pressure cavity 2216*a* is collectively defined by the valve cap 221*a* and the actuating member 223*a* (see FIG. 6A). The vibration film 221*a* of the actuating member 223*a* is a single-layered metallic structure. For example, the vibration film 2231*a* is made of stainless steel or copper, but not limited to the materials listed above. In some embodiments, the vibration film 2231*a* is a two-layered structure, which includes a metallic layer and a biochemical-resistant polymeric sheet attached on the metallic layer. The actuator 2232*a* is attached on the vibration film 2231*a*. The actuator 2232*a* is a piezoelectric plate made of highly piezoelectric material such as lead zirconate titanate (PZT). The cover plate 224*a* is disposed on the actuator 2232*a*. The valve membrane 222*a*, the valve cap 221*a* and the actuating member 223*a* are clamped between the cover plate 224*a* and the first surface 211 of the flow-gathering module 21, thereby assembling the first chamber 22*a* of the first double-chamber actuating structure 22 of the fluid transportation device 2 as shown in FIG. 3A.

Please refer to FIGS. 2, 3A and 6A. FIG. 6A is a schematic cross-sectional view illustrating the fluid transportation device shown in FIG. 3A and taken along the line A-A, wherein the fluid transportation device is in a non-actuation status. The cross-sectional view and the operations of the fluid transportation device taken along the line a-a are similar to those shown in FIG. 6A, and are not redundantly described herein. For brevity, only the fluid transportation device taken along the line A-A is illustrated as follows. After the first chamber 22*a* of the first double-chamber actuating structure 22 is mounted on the first surface 211 of the flow-gathering module 21, the inlet branch flow path 213 of the flow-gathering module 21 is aligned with the inlet valve structure 2221*a* of the valve membrane 222*a* and the inlet buffer cavity 2215*a* and the inlet valve channel 2213*a* of the valve cap 221*a*. At the same time, the outlet confluent flow path 214 of the flow-gathering module 21 is aligned with the outlet buffer cavity 2141*a*, the outlet valve structure 2222*a* of the valve membrane 222*a* and the outlet valve channel 2214*a* of the valve cap 221*a*.

As previously described, the recess structure 217*a* is formed in the first surface 211 of the flow-gathering module 21 and annularly surrounds the inlet branch flow path 213. Since the thickness of the sealing ring 26 accommodated in the recess structure 217*a* is greater than the depth of the recess structure 217*a*, the sealing ring 26 is partially protruded out of the recess structure 217*a* to form a convex structure. Under this circumstance, the inlet valve slice 22211*a* of the inlet valve structure 2221*a* of the valve membrane 222*a* is raised. The convex structure is sustained against the valve membrane 222*a* to provide a pre-force on the inlet valve structure 2221*a*. The pre-force results in a stronger sealing effect to prevent the fluid from being returned back. In addition, due to the convex structure, a gap is formed between the inlet valve structure 22211*a* and the first surface 211 of the flow-gathering module 21. The gap is helpful for opening the inlet valve structure 2221*a* during the fluid enters the gap. Similarly, after the sealing ring 27 is accommodated in the recess structure 22122*a* that is formed in the lower surface 2212*a* of the valve cap 221*a* and annularly surrounds the outlet buffer cavity 2141*a*, the sealing ring 27 is partially protruded out of the recess structure 22122*a* to form a convex structure. As such, the outlet valve structure 2222*a* of the valve membrane 222*a* is downwardly raised with respect to the valve cap 221*a*, and a gap is formed between the outlet valve slice 22221*a* and the lower surface 2212*a* of the valve cap 221*a*. The convex structures of the outlet valve structure 2222*a* and the inlet valve structure 2221*a* are arranged on opposite sides of the valve membrane 222*a*. The functions of the convex structure of the outlet valve structure 2222*a* are similar to that of the inlet valve structure 2221*a*, and are not redundantly described herein. As mentioned above, the convex structures are defined by the recess structures (217*a*, 22122*a* ) and corresponding sealing rings (26, 27). Alternatively, the convex structures may be directly formed on the flow-gathering module 21 and the valve cap 221*a* by a semiconducting fabricating method such as a photolithography and etching process, an electroplating process or an electroforming process. Alternatively, the convex structures may be integrally formed with the flow-gathering module 21 and the valve cap 221*a* by ejecting thermoplastic material. The remainder of the valve membrane 222*a* is attached between the valve cap 221*a* and the flow-gathering module 21. The sealing rings 26 and 27 received in the recess structures 218*a*, 219*a*, 22121*a*, 22123*a* and 22111*a* may facilitate close contact between the valve membrane 222*a*, the valve cap 221*a* and the flow-gathering module 21, thereby avoiding fluid leakage.

Please refer to FIG. 6A again. The valve cap 221*b*, the valve membrane 222*b*, the actuating member 223*b* and the cover plate 224*b* of the second chamber 22*b* of the first double-chamber actuating structure 22 are disposed on the second surface 212 of the flow-gathering module 21. The first chamber 22*a* and the second chamber 22*b* are mirror-symmetrical with respect to the flow-gathering module 21. The configurations and functions of the second chamber 22*b* are identical to those of the first chamber 22*a*. The configurations and functions of the first chamber 23*a* and the second chamber 23*b* of the second double-chamber actuating structure 23 are identical to those of the first chamber 22*a* and the second chamber 22*b* of the first double-chamber actuating structure 22. For brevity, the fluid transportation process is illustrated by referring to the first chamber 22*a* of the first double-chamber actuating structure 22. It is of course that the second chamber 22*b* and the first chamber 22*a* of the first double-chamber actuating structure 22 and the second chamber 23*b* and the first chamber 23*a* of the second double-chamber actuating structure 23 are synchronously actuated to transport the fluid.

Figure 6B:
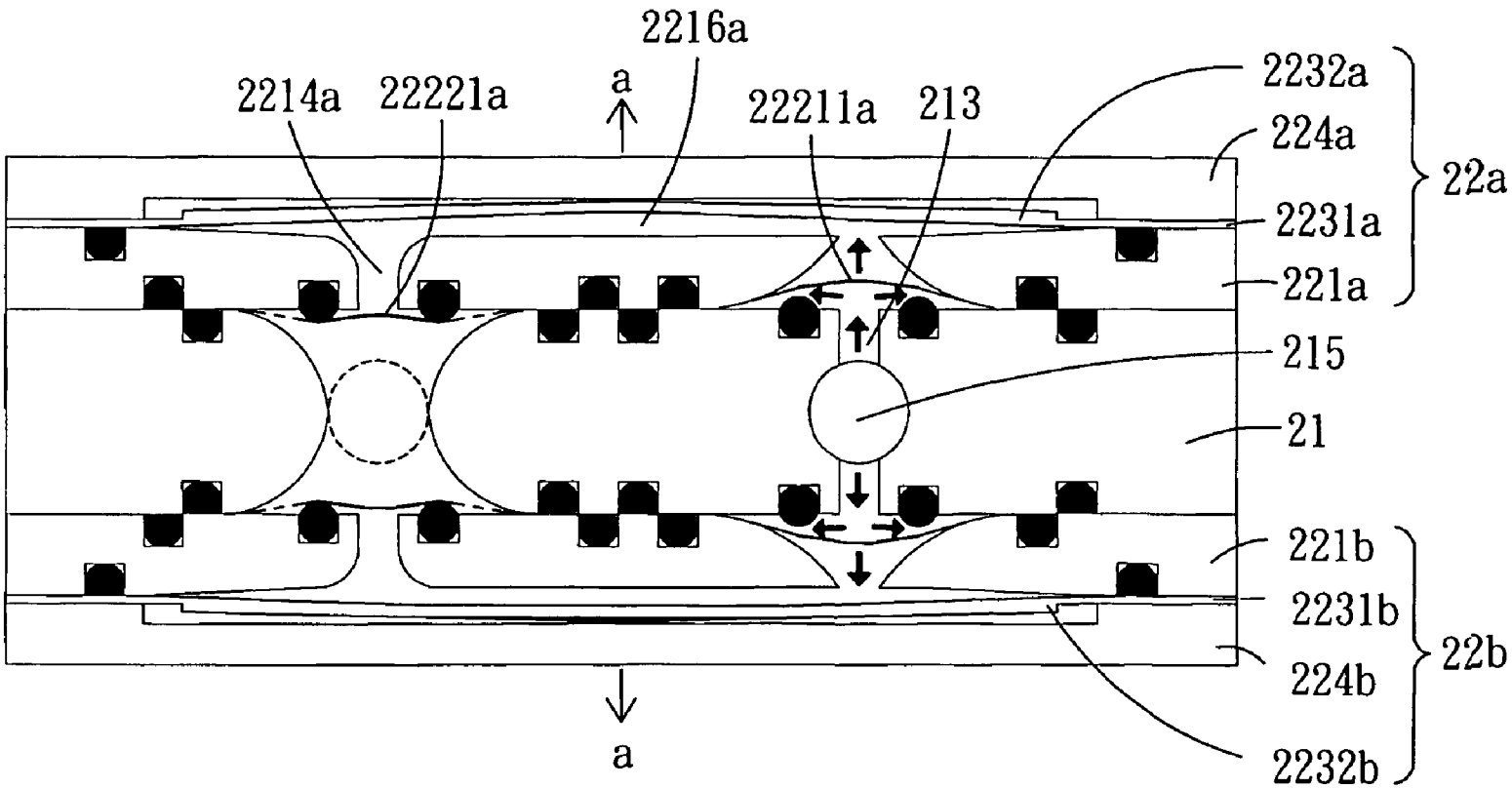
FIG. 6B is a schematic cross-sectional view illustrating the fluid transportation device shown in FIG. 6A, in which the volume of the pressure cavity is expanded.
Figure 6C:
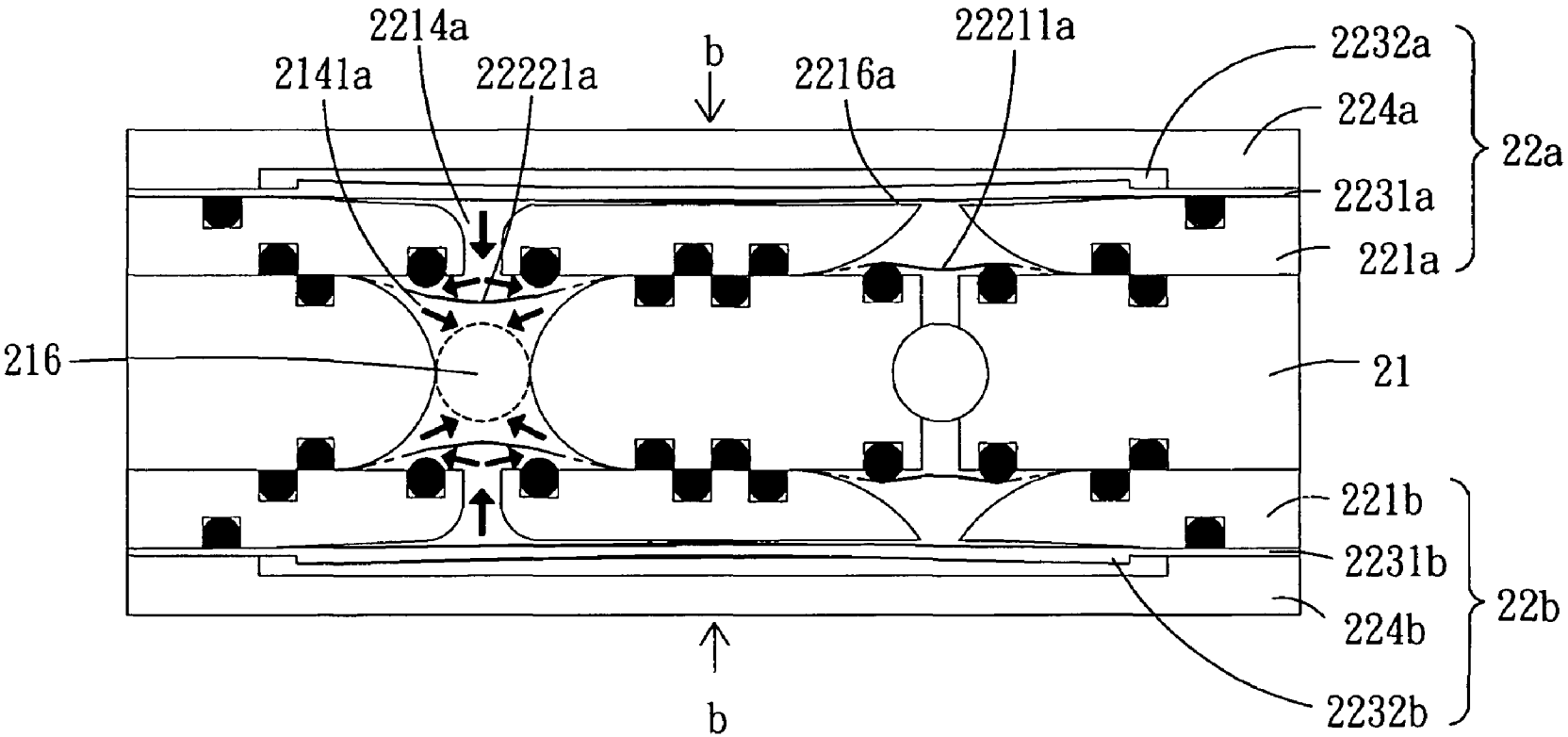
FIG. 6C is a schematic cross-sectional view illustrating the fluid transportation device shown in FIG. 6A, in which the volume of the pressure cavity is shrunken.

FIG. 6B is a schematic cross-sectional view illustrating the fluid transportation device of the present invention, in which the volume of the pressure cavity shown in FIG. 6A is expanded. Take the first chamber 22*a* for example. When a voltage is applied on the actuator 2232*a*, the actuating member 223*a* is deformed in the direction "a" and thus the volume of the pressure cavity 2216*a* is expanded to result in a negative pressure difference and a suction. Due to the negative pressure difference and the suction, the inlet valve structure 2221*a* and the outlet valve structure 2222*a* of the valve membrane 222*a* are uplifted. Since the inlet valve structure is aligned with the inlet buffer cavity 2215*a*, the inlet valve slice 22211*a* is quickly opened in response to the pre-force provided by the recess structure 217*a* and the sealing ring 26 (see FIGS. 6B and 7B). As such, a great amount of fluid is introduced into the inlet channel 215 of the flow-gathering module 21 and then branched by the inlet branch flow paths 213. As such, the fluid is transported into the first chamber 22*a*, and then transported to the pressure cavity 2216*a* through the perforations 22212*a* of the inlet valve structure 2221*a* of the valve membrane 222*a* and the inlet buffer cavity 2215*a* and inlet valve channel 2213*a* of the valve cap 221*a*. At this moment, the pulling force exerted on the outlet valve structure 2222*a* of the valve membrane 222*a* and the pulling force exerted on the inlet valve structure 2221*a* are in the same direction. In addition, the outlet valve structure 2222*a* close to the lower surface 2212*a* of the valve cap 221*a* and the inlet valve structure 2221*a* close to the lower surface 2212*a* of the valve cap 221*a* have different structures. The sealing ring 27 accommodated in the recess structure 22122*a* provides a pre-sealing effect. The pulling force exerted on the outlet valve structure 2222*a* of the valve membrane 222*a* causes the outlet valve slice 22221*a* to seal the outlet valve channel 2214*a*, and thus the fluid will not be returned back (see FIGS. 6B and 8B).

In a case that the direction of the electric field applied on the actuator 2232*a* is changed such that the actuator 242 is subject to deformation in the direction "b" (see FIG. 6C), the actuating member 223*a* is deformed toward the flow-gathering module 21 to compress the pressure cavity 2216*a*. As such, the volume of the pressure cavity 2216*a* is shrunk to result in a positive pressure difference from the surrounding environment. In response to the positive pressure difference, an impulse is applied on the fluid within the pressure cavity 2216*a*. Due to the impulse, a great amount of fluid is instantly exhausted out of the pressure cavity 2216*a* through the outlet valve channel 2214*a*. At the same time, the impulse generated from the positive pressure difference of the pressure cavity 2216*a* and in the direction toward the flow-gathering module 21 is also exerted on the inlet valve structure 2221*a* and the outlet valve structure 2222*a* of the valve membrane 222*a*. As such, a pre-force will quickly open the outlet valve slice 22221*a* of the outlet valve structure 2222*a*. When the outlet valve slice 22221*a* is opened, the fluid in the pressure cavity 2216*a* is transported to the outlet buffer cavity 2141*a* and the outlet confluent flow paths 214 through the outlet valve channel 2214*a* of the valve cap 221*a* and the perforations 22222*a* of the outlet valve structure 2222*a* of the valve membrane 222*a* (see FIGS. 6C and 8C), and then exhausted out of the fluid transportation device through the outlet channel 216. Meanwhile, a fluid transporting cycle is completed.

On the other hand, the inlet branch flow path 213 close to the first surface 211 of the flow-gathering module 21 and the outlet confluent flow path 214 close to the first surface 211 of the flow-gathering module 21 have different structures. In addition, the sealing ring 26 provides a pre-sealing effect. As such, when the impulse in the direction toward the flow-gathering module 21 is exerted on the inlet valve structure 2221*a*, the inlet valve structure 2221*a* is pressed down to its closed position by the inlet valve slice 22211*a*, and thus the inlet branch flow path 213 is sealed (see FIGS. 6C and 7C). At this moment, no fluid is allowed to flow through the inlet valve structure 2221*a* and thus the fluid will not be returned back.

In a case that the actuator 2232*a* is subject to upward deformation due to a voltage applied thereon, the volume of the pressure cavity 2216*a* is expanded. As such, the fluid is transported from the inlet buffer cavity 2215*a* into the pressure cavity 2216*a* through the inlet valve channel 2213*a*. In a case that the actuating member 223*a* is subject to downward deformation, the volume of the pressure cavity 2216*a* is shrunk and thus the fluid is exhausted out of the pressure cavity 2216*a*. That is, by changing the direction of the electric field applied on the actuating member 223*a* is changed, the actuating member 223*a* is moved in a reciprocating manner, so that the fluid transportation device 2 is capable of pumping and releasing the fluid and achieving the purpose of transporting the fluid.

Figure 7A:
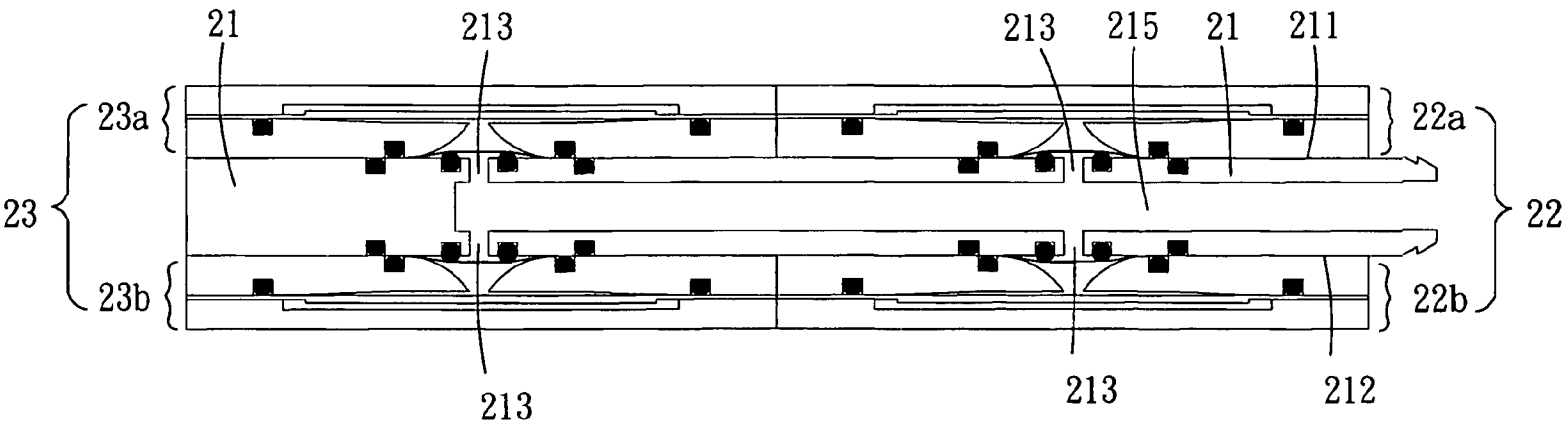
FIG. 7A is a schematic cross-sectional view illustrating the fluid transportation device shown in FIG. 3A and taken along the line B-B.
Figure 7B:
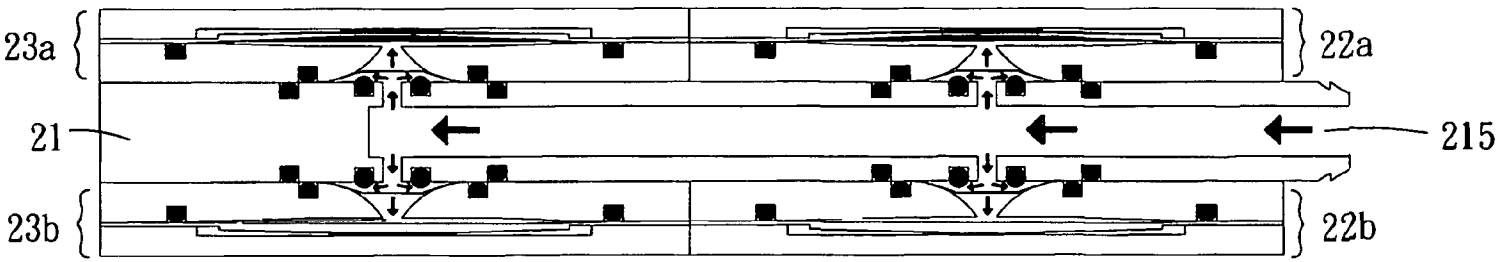
FIG. 7B is a schematic cross-sectional view illustrating the fluid transportation device shown in FIG. 7A, in which the volume of the pressure cavity is expanded.
Figure 7C:
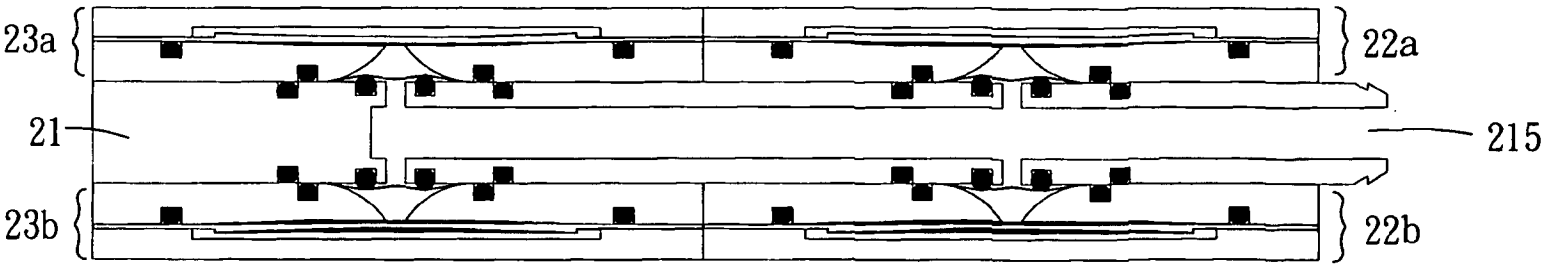
FIG. 7C is a schematic cross-sectional view illustrating the fluid transportation device shown in FIG. 7A, in which the volume of the pressure cavity is shrunken.
Figure 8A:
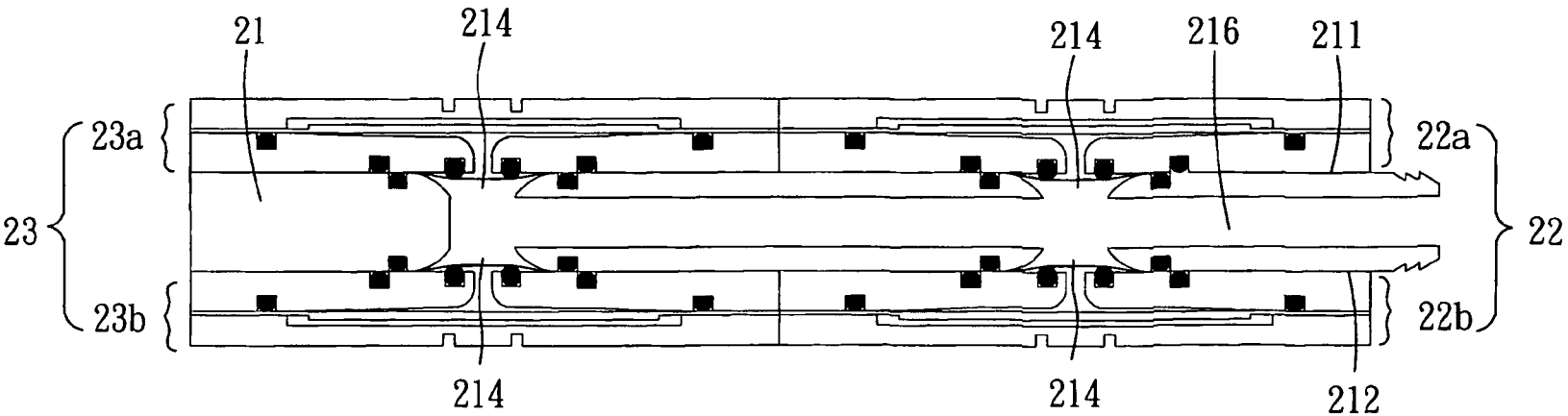
FIG. 8A is a schematic cross-sectional view illustrating the fluid transportation device shown in FIG. 3A and taken along the line C-C.

Please refer to FIGS. 7A~7C and FIGS. 8A~8C. FIG. 7A is a schematic cross-sectional view illustrating the fluid transportation device shown in FIG. 3A and taken along the line B-B. FIG. 8A is a schematic cross-sectional view illustrating the fluid transportation device shown in FIG. 3A and taken along the line C-C. As shown in FIG. 7A, the inlet channel 215 is a pipeline between the first surface 211 and the second surface 212 of the flow-gathering module 21. The external flow is introduced into the fluid transportation device 2 through the inlet channel 215. The inlet channel 215 is communicated with the multiple inlet branch flow paths 213, so that the fluid is transported though the inlet branch flow paths 213 to the first chamber 22*a* and the second chamber 22*b* of the first double-chamber actuating structure 22 and the first chamber 23*a* and the second chamber 23*b* of the second double-chamber actuating structure 23. As shown in FIG. 8A, the outlet channel 216 is a pipeline between the first surface 211 and the second surface 212 of the flow-gathering module 21. The internal flow is ejected out of the fluid transportation device 2 through the outlet channel 216. The outlet channel 216 is communicated with the multiple outlet confluent flow paths 214, so that the fluid from the first chamber 22*a* and the second chamber 22*b* of the first double-chamber actuating structure 22 and the first chamber 23*a* and the second chamber 23*b* of the second double-chamber actuating structure 23 is exhausted out of the fluid transportation device 2 through the outlet channel 216.

Figure 8B:
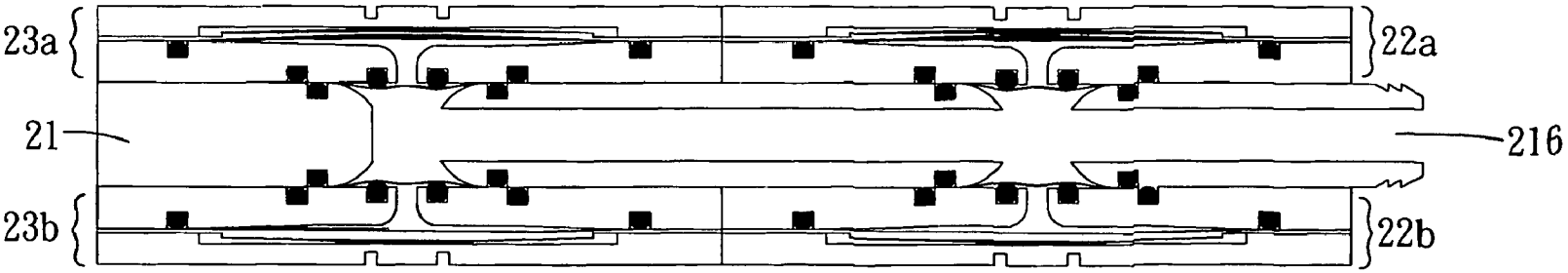
FIG. 8B is a schematic cross-sectional view illustrating the fluid transportation device shown in FIG. 8A, in which the volume of the pressure cavity is expanded.

Please refer to FIGS. 7B and 8B. As shown in FIG. 7B, when the fluid is introduced into the inlet channel 215, a portion of fluid is firstly transported to the first chamber 22*a* and the second chamber 22*b* of the first double-chamber actuating structure 22 through a first inlet branch flow path 213, and then transported to the first chamber 23*a* and the second chamber 23*b* of the second double-chamber actuating structure 23 through a second inlet branch flow path 213. If the fluid transportation device 2 has three or more double-chamber actuating structures, the rest may be deduced by analogy.

When the actuators includes in the first chamber 22*a* and the second chamber 22*b* of the first double-chamber actuating structure 22 and the first chamber 23*a* and the second chamber 23*b* of the second double-chamber actuating structure 23 are vibrated at the same frequency, all actuating members are externally raised. As such, all inlet valve structures are opened and the fluid is pumped into the chambers (see FIG 7B). At the same time, all outlet valve structures are more tightly closed (see FIG. 8B), and thus the fluid will not be returned back.

Figure 8C:
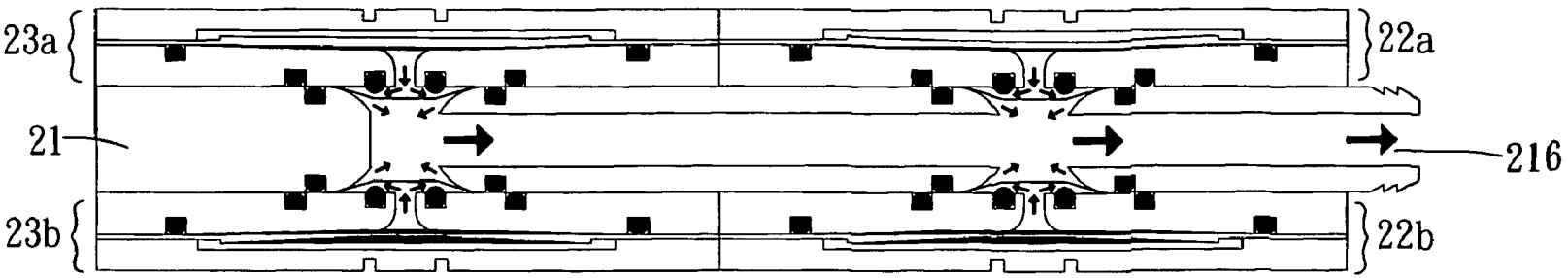
FIG. 8C is a schematic cross-sectional view illustrating the fluid transportation device shown in FIG. 8A, in which the volume of the pressure cavity is shrunken.

Please refer to FIGS. 7C and 8C. When the actuators includes in the first chamber 22*a* and the second chamber 22*b* of the first double-chamber actuating structure 22 and the first chamber 23*a* and the second chamber 23*b* of the second double-chamber actuating structure 23 are vibrated at the same frequency, all actuating members are internally concaved to compress the pressure cavity to result in a positive pressure difference. As such, all outlet valve structures are opened and the fluid to discharge the fluid (see FIG. 8C). At the same time, all inlet valve structures are more tightly closed (see FIG. 7C), and thus the fluid will not be returned back. The detail operations have been described in FIG. 6, and are not redundantly described herein.

From the above description, the fluid transportation device of the present invention includes a flow-gathering module and multiple double-chamber actuating structures. The multiple double-chamber actuating structures are symmetrically stacked on the flow-gathering module. For assembling the fluid transportation device, two sets of valve membranes, valve caps and actuating members are respectively stacked on the first and second surfaces of the flow-gathering module, thereby forming a double-chamber actuating structure with two mirror-symmetrical chambers. Next, multiple double-chamber actuating structures are successively arranged on the fluid transportation device in a side-by-side manner. As a consequence, the double-chamber actuating structures are horizontally expanded. In comparison with the conventional micro pump with multiple single-chamber structures, the fluid transportation device of the present invention has increased flow rate and head. In addition, the fluid transportation device of the present invention has reduced overall volume, thereby meeting the miniaturization demand.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A fluid transportation device having multiple double-chamber actuating structures for transporting a fluid, said fluid transportation device comprising:

a flow-gathering module comprising two surfaces opposed to each other, multiple first flow paths and multiple second flow paths running through said two surfaces, an inlet channel arranged between said two surfaces and communicated with said multiple first flow paths, and an outlet channel arranged between said two surfaces and communicated with said multiple second flow paths; and multiple double-chamber actuating structures arranged on said flow-gathering module side by side, wherein each double-chamber actuating structure includes a first chamber and a second chamber arranged symmetrically opposite one another on said two surfaces of said flow-gathering module, and each of said first chamber and said second chamber includes a valve cap arranged over said flow-gathering module and having a first valve channel and a second valve channel, a valve membrane arranged between said flow-gathering module and said valve cap, and an actuating member having a periphery fixed on said valve cap.

2. The fluid transportation device having multiple double-chamber actuating structures according to claim 1 wherein said valve membrane includes a first valve structure and a second valve structure corresponding to said first flow path and said second flow path, respectively.

3. The fluid transportation device having multiple double-chamber actuating structures according to claim 2 wherein a first buffer zone is arranged between said valve membrane and said valve cap, and a second buffer zone is arranged between said valve membrane and said flow-gathering module.

4. The fluid transportation device having multiple double-chamber actuating structures according to claim 3 wherein said first valve structures, said first buffer zones and said first valve channels of said first chamber and said second chamber are aligned with said first flow path of said flow-gathering module, and said second buffer zones, said second valve structures and said second valve channels of said first chamber and said second chamber are aligned with said second flow path of said flow-gathering module.

5. The fluid transportation device having multiple double-chamber actuating structures according to claim 1 wherein said actuating member and said valve cap collectively define a pressure cavity.

6. The fluid transportation device having multiple double-chamber actuating structures according to claim 1 wherein said fluid includes a gas and a liquid.

7. The fluid transportation device having multiple double-chamber actuating structures according to claim 1 wherein said actuating member includes an actuator and a vibration film.

8. The fluid transportation device having multiple double-chamber actuating structures according to claim 1 wherein said first flow paths are inlet branch flow paths, and said second flow paths are outlet confluent flow paths.

9. The fluid transportation device having multiple double-chamber actuating structures according to claim 1 wherein said actuating members included in said first chambers and said second chambers of said multiple double-chamber actuating structures are vibrated at the same frequency.

* * * * *